United States Patent [19]

Tanaka et al.

[11] 4,272,745

[45] Jun. 9, 1981

[54] ELECTROMAGNETIC RELAY

[75] Inventors: Takashi Tanaka, Takatsuki; Hirofumi Koga, Kyoto, both of Japan

[73] Assignee: Omron Tateisi Electronics Co., Kyoto, Japan

[21] Appl. No.: 48,157

[22] Filed: Jun. 13, 1979

[30] Foreign Application Priority Data

Jun. 30, 1978 [JP] Japan ..... 53-80321
Jun. 30, 1978 [JP] Japan ..... 53-80323

[51] Int. Cl.[3] ..... H01H 67/02

[52] U.S. Cl. ..... 335/128; 335/203; 335/276

[58] Field of Search ..... 335/128, 133, 202, 203, 335/276

[56] References Cited

U.S. PATENT DOCUMENTS

| | | | |
|---|---|---|---|
| 3,701,062 | 10/1972 | Koga et al. | 335/202 X |
| 3,906,416 | 9/1975 | Sprando | 335/128 |
| 3,993,971 | 11/1976 | Ono et al. | 335/202 |
| 4,010,433 | 3/1977 | Nishimura et al. | 335/202 X |

*Primary Examiner*—George Harris
*Attorney, Agent, or Firm*—Wegner & Bretschneider

[57] ABSTRACT

A flat pack type electromagnetic relay having a bracket-shaped stationary core and a bracket-shaped armature is disclosed. The core is provided with a spool for an energizing coil and the spool has engaging portions extending from its end flanges. The armature is pivotally supported by the engaging portions to close or open electrical contacts in response to a current applied to the coil.

8 Claims, 6 Drawing Figures

ELECTROMAGNETIC RELAY

BACKGROUND OF THE INVENTION

This invention relates to an electromagnetic relay and, more particularly, to a flat pack type electromagnetic relay having a flat pack which houses necessary parts such as a magnetic core, a coil, an armature, and contacts.

A recently developed flat pack type dual-in-line electromagnetic relay with lead terminals has the advantage of reduced scale in comparison with the more conventional type relay which comprises a large housing, especially, of great height.

Such a flat pack type relay, however, has the disadvantage that mass production is difficult because of the close dimensional tolerances that must be satisfied for each necessary component part as well as for the assembly.

Therefore, it is an object of the present invention to provide an electromagnetic relay which is compact and simple in construction.

It is another object of the present invention to provide an electromagnetic relay which is easy to assemble, especially in that its component parts can be assembled from one direction.

It is another object of the present invention to provide an electromagnetic relay which lends itself well to mass production.

DETAILED DESCRIPTION OF THE PREFERRED EMBODIMENT

Figure 1:
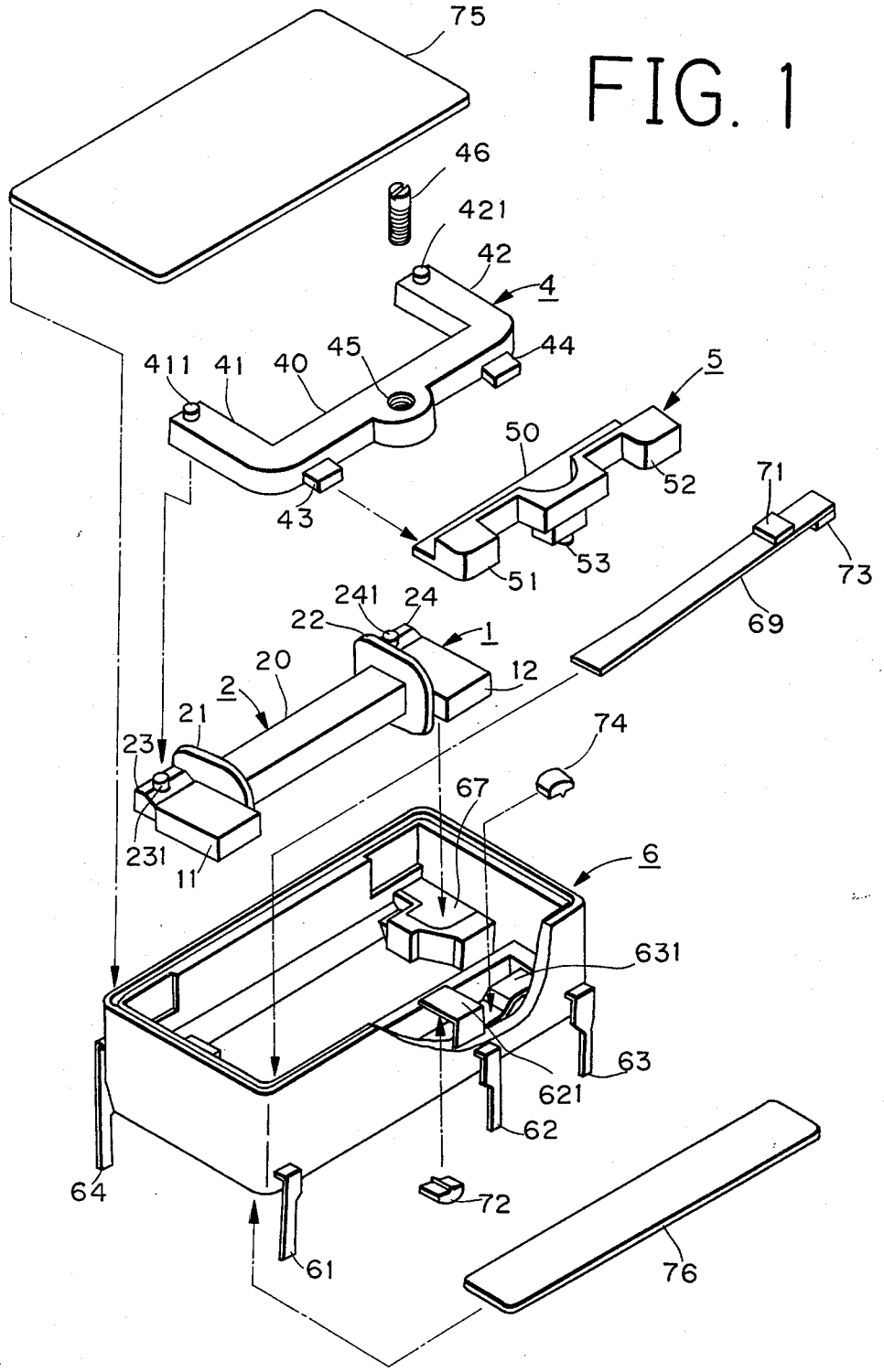
FIG. 1 is an exploded perspective view showing an electromagnetic relay in accordance with the present invention.
Figure 2:
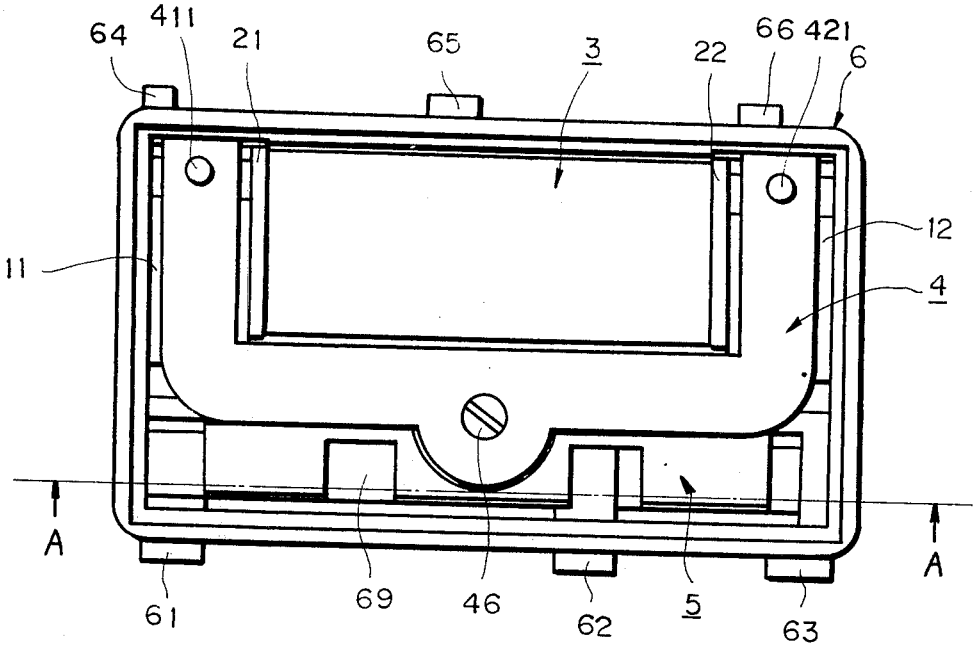
FIG. 2 is a schematic plan view of the electromagnetic relay shown in FIG. 1.
Figure 3:
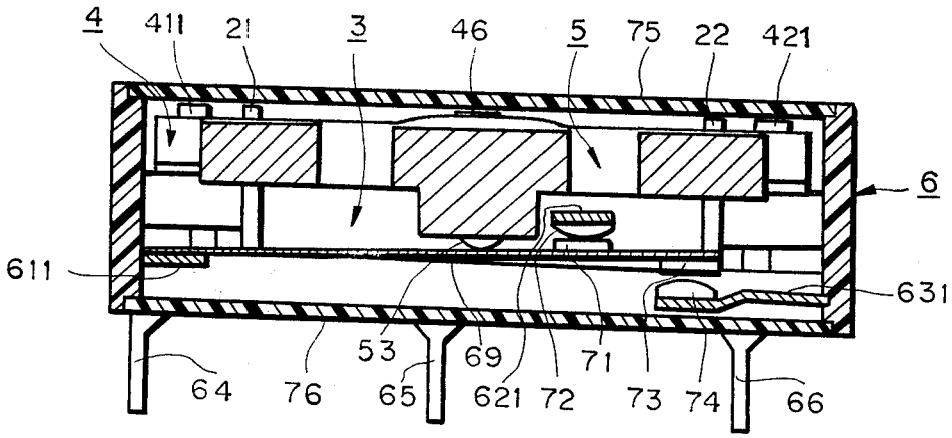
FIG. 3 is a sectional view taken along the line A—A of FIG. 2.
Figure 4:
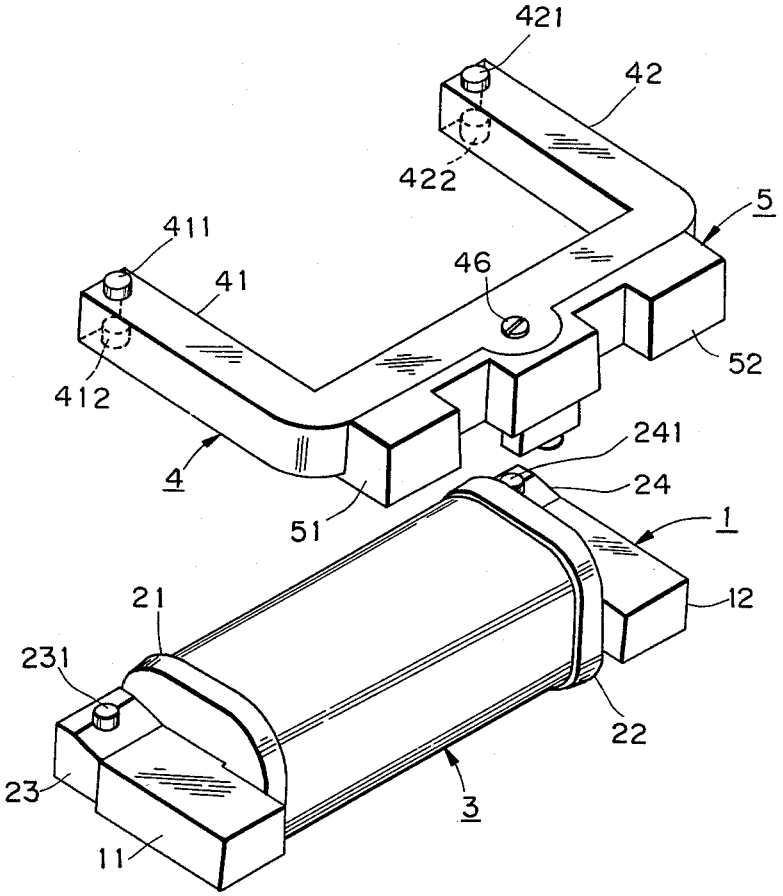
FIG. 4 is a perspective view showing a combination of a stationary core and an armature in the relay shown in FIG. 1 to FIG. 3.

The present invention is now described with reference to the drawings. In FIG. 1 through FIG. 3, there is shown an electromagnetic relay in accordance with the present invention which comprises a stationary core 1, a spool 2 secured to the core 1, a coil 3, an armature 4, two pairs of contacts 71, 72, and 73, 74, a driving member 5 for driving the contacts to be closed or opened, a housing 6 with a plurality of lead terminals 61 through 66, and cover plates 75 and 76.

The housing 6 houses the above-mentioned necessary component parts. The bracket-shaped stationary core 1 has two legs 11 and 12 and is made of a magnetic metal plate.

The spool 2 with a bobbin 20, two end flanges 21 and 22, and two guide projections 231 and 241 is made of an electrically insulating material such as a plastics and is secured to the stationary core 1. Flanges 21 and 22 have engaging portions 23 and 24, respectively, formed integrally therewith.

The coil 3 is wound around the bobbin 20.

The armature 4, which is constructed of a magnetic metal plate, has a main portion 40, two legs 41 and 42, two pairs of projections 411, 421 and 43, 44 and a threaded hole 45. Armature 4 is provided with a driving member 5 molded from an insulating material such as plastics which has a lower plate member 50, two acceptors 51 and 52 each having a recess (not shown), and a projection 53.

The driving member 5 is engaged with the armature 4 by coupling projections 43 and 44 with the recesses of acceptors 51 and 52.

A screw 46 is set in the threaded hole 45 for adjustably pressing the lower plate member 50 downward as described later.

The housing 6, made of a plastic material, has terminals 61 through 66, one end of each terminal extending into the housing with the other end being aligned in what is known as the dual-in-one manner. A movable blade 69, one end of which is affixed to an inner portion 611 of lead 61, is provided with two movable contacts 71 and 73.

A stationary contact 72 is affixed to an inner portion 621 of lead 62 and another stationary contact 74 is affixed to an inner portion 631 of lead 63. Leads 65 and 66 are connected to the coil 3, lead 61 is a common terminal connected to the movable blade 69, lead 62 is a normally closed terminal, and lead 63 is a normally opened terminal.

Lead 64 is a ground terminal connected to the stationary core 1. A process for assembling the above electromagnetic relay is now illustrated.

Housing 6 is formed by plastic molding.

Terminal leads 61 to 66 and metal piece 67 are molded in the side wall and bottom wall of the housing. Leads 61 to 66 and metal piece 67 are each shaped by known methods, for example, by stamping a metal plate.

Prior to molding, the stationary contacts 72 and 74 are affixed, by welding, to the inner portions 621 and 631 of leads 62 and 63, respectively. After molding, a movable blade 69 of resilient metal having movable contacts 71 and 73 is connected to the inner portion 611 of lead 61 by welding so as to normally keep the movable contact 71 in contact with the stationary contact 72.

Stationary core 1, to which spool 2 and coil 3 are previously secured, is inserted and stably positioned in the housing 6 by welding legs 11 and 12 to the inner portion (not shown) of lead 64 and metal piece 67, respectively and, then, terminals of the coil 3 are connected to the leads 65 and 66.

Spool 2 is formed by plastic molding and all of its members including bobbin 20, end flanges 21 and 22, engaging portions 23 and 24, and guide projections 231 and 241 are formed in one piece.

The spool 2 is made by superposing a plastic resin material on the main portion of the stationary core 1 so as to provide a firm bond between the resin film and core metal. Said engaging portions 23 and 24 are located at ends opposite to said legs 11 and 12.

Armature 4, to which driving member 5 is previously attached, is placed in position on the stationary core 1.

Figure 5:
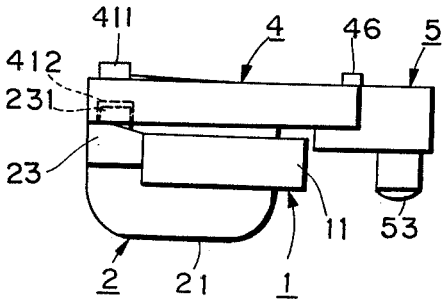
FIG. 5 and FIG. 6 are schematic side views showing the relation between the stationary core and the armature.
Figure 6:
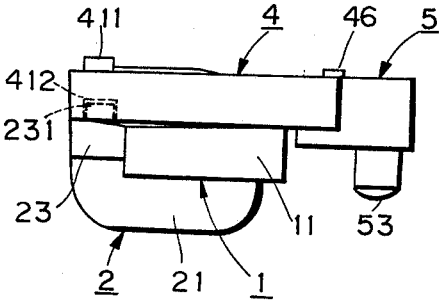

Guide projections 231 and 241 define the position of armature 4 by engaging themselves with recesses 412 and 422. Since the height of guide projections 231 and 241 is less than the depth of recesses 412 and 422 as shown in FIG. 5 and FIG. 6, the armature 4 is supported by the legs 11 and 12 of stationary core 1 and the engaging portions 23 and 24 which project from the upper surface of said legs 11 and 12.

Recesses 412 and 422 are formed by pressing and the resulting projections 411 and 421 are used for stoppers, which are shown to lie near the cover plate 75 in FIG. 3, and prevent the armature 4 from disengaging itself from spool 2.

The contact pressure between the movable contact 73 and stationary contact 74 is adjusted as follows:

A detection circuit including a lamp and a power source is connected in series between the leads 61 and 63. Screw 46 is initially held in the position not pressing the lower plate member 50 of the driving member 5. When the coil 3 is energized, armature 4 is attracted by the core 1 forming a closed electromagnetic circuit between the core 1 and main portion 40 of the armature 4.

In this condition, the movable blade 69 is not pressed, or substantially not pressed, downward by the projection 53 of the driving member 5, so that the lamp of the detection circuit does not light.

By rotating the screw 46 in the downward direction, the lower plate member 50 of the driving member 5 is pressed downward, deformed in the shape of a bow, causing the driving member 5 to be more tightly affixed to the armature 4.

Since the driving member 5 is engaged with the armature 4 at both ends, the projection 53 moves downward with the movement of the lower plate member 50 pressing the movable blade 69 downward.

When the movable contact 73 contacts the stationary contact 74, the above monitor lamp is lit, then the screw 46 is rotated a little more by a predetermined amount, for example, one-half revolution, to set a desired contact pressure between the movable contact 73 and stationary contact 74. Following this, an upper cover plate 75 and a lower cover plate 76 are secured to the housing 6, for example with a cement or by ultrasonic welding.

If the normally closed contact 72 is not required, the lower cover plate 76 may be omitted, since an opening at the bottom of housing 6, which is inevitablly formed by a jig during the molding of the housing 6 in this embodiment, is negligible.

The assembled relay operates as follows:

Normally coil 3 is not energized, contacts 71 and 72 remain closed and contacts 73 and 74 are open. When the coil is energized, armature 4 is attracted by the stationary core 1, rotating clockwise in FIG. 5 and FIG. 6, to open the contacts 71 and 72, and close the contacts 73 and 74.

It is noted that the armature 4 is pivotally supported by the engaging portions 23 and 24.

When coil 3 is deenergized, armature 4 is rotated counterclockwise by receiving an upward spring force from movable blade 69 at projection 53 of the driving member 5, and the relay returns to the normal condition.

What is claimed is:

1. An electromagnetic relay comprising a bracket-shaped stationary core having a main portion and two leg portions, a spool having two end flanges on opposite sides of the axial extent of said spool, said spool being secured to said stationary core, a coil wound around said spool, an armature, and a pair of contacts comprising a movable contact and a stationary contact which are closed or opened in response to the movement of said armature, said spool having a pair of engaging portions on opposite sides thereof extending from said end flanges, said armature being a bracket-shaped member having a main portion and two leg portions, said leg portions being engaged with said engaging portions of said spool whereby said armature is pivotally supported by said engaging portions to close or open said contacts in response to a current applied to said coil for forming a closed magnetic circuit between said stationary core and said armature, said engaging portions being located in positions respectively opposite to said leg portions of said stationary core.

2. An electromagnetic relay according to claim 1, wherein said engaging portions project from the upper surface of the leg portions of said stationary core.

3. An electromagnetic relay according to claim 1, wherein the relay further comprises a housing molded with a plurality of leads for supporting said stationary core and housing said stationary core, said spool, said contacts and said armature.

4. An electromagnetic relay according to claim 3, wherein said stationary core is mechanically affixed to one of said leads in said housing.

5. An electromagnetic relay according to claim 4, wherein said stationary core is electrically connected to a ground lead.

6. An electromagnetic relay according to claim 1, wherein said armature is provided with a driving member of insulating material for driving said movable contact.

7. An electromagnetic relay according to claim 6, wherein said driving member is attached to said armature in such a manner that the contact pressure between said contacts is adjustable.

8. An electromagnetic relay according to claim 7 wherein said driving member includes a plate member and means at opposite ends thereof for engaging said driving member with said armature, said armature further comprising a threaded bore and a screw engaging with said threaded bore and projecting therefrom to press against said plate member to deform said driving member and adjust said contact pressure.

* * * * *